US006095573A

United States Patent [19]

Rozema

[11] Patent Number: 6,095,573

[45] Date of Patent: Aug. 1, 2000

[54] TRANSLATING HANDLE ASSEMBLY

[75] Inventor: Timothy S. Rozema, Irvine, Calif.

[73] Assignee: Hartwell Corporation, Placentia, Calif.

[21] Appl. No.: 09/282,502

[22] Filed: Mar. 31, 1999

[51] Int. Cl.[7] ..... E05C 3/06; E05C 3/16; E05C 7/00; E05C 9/12

[52] U.S. Cl. ..... 292/51; 292/336.3; 292/DIG. 31; 70/208

[58] Field of Search ..... 292/51, 35, 39, 292/336.3, DIG. 31, 142, 4; 70/208

[56] References Cited

U.S. PATENT DOCUMENTS

| | | | |
|---|---|---|---|
| 2,104,838 | 1/1938 | Leonard | 292/DIG. 31 |
| 2,186,865 | 1/1940 | Hubbell | 70/208 |
| 2,189,227 | 2/1940 | Schoch | 70/208 |
| 2,201,963 | 5/1940 | Wartian | 70/208 |
| 2,239,301 | 4/1941 | Papst | 292/DIG. 37 |
| 2,246,708 | 6/1941 | Wieben | 70/208 |
| 4,631,937 | 12/1986 | Debus et al. | 70/207 |
| 5,094,483 | 3/1992 | James | 292/39 |
| 5,469,725 | 11/1995 | Yamada | 70/208 |
| 5,862,690 | 1/1999 | Jancsek | 70/224 |

FOREIGN PATENT DOCUMENTS

| | | | |
|---|---|---|---|
| 782519 | of 0000 | France | 70/208 |
| 657234 | 3/1938 | Germany | 70/208 |

OTHER PUBLICATIONS

Hartwell Corporation Engineering Drawing, Handle Assy Cargo & Passenger Door, H3459.

Hartwell Corporation Engineering Drawing, Handle Assy –Cargo & Passenger Door, H2755, 2 Sheets.

*Primary Examiner*—B. Dayoan
*Assistant Examiner*—John B. Walsh
*Attorney, Agent, or Firm*—Pretty, Schroeder & Poplawski, P.C.

[57] ABSTRACT

Disclosed is a translating handle assembly that actuates a latch mechanism to releasably secure a door to a structure. The handle assembly includes an interior handle, an exterior handle, and a translating shaft. The translating shaft is connected between the interior handle and the exterior handle. The interior handle is rotatable between closed and open positions and the exterior handle rotates in unison with the interior handle between closed and open positions. In the closed position, the exterior handle is disposed within the recess of an exterior handle housing. Rotation of the interior handle between closed and open positions causes the translating shaft to move axially between non-extended and extended positions displacing the exterior handle axially out of the recess of the exterior handle housing.

16 Claims, 6 Drawing Sheets

TRANSLATING HANDLE ASSEMBLY

BACKGROUND OF THE INVENTION

1. Field of the Invention

The present invention relates to the mechanical arts. In particular, this invention relates to a handle assembly that actuates a latch mechanism for releasably securing a door to a structure.

2. Discussion of the Related Art

Doors for use with vehicles, such as ships or aircraft, include handle assemblies that control latch mechanisms which secure and release the door to and from an associated vehicle structure. After the door has been released by the handle assembly, the door can then be opened to allow individuals to move in and out of the vehicle structure or to provide access to items stored within the structure. Typically, these handle assemblies are provided with interior and exterior handles so that the door can be opened from either inside or outside the vehicle structure.

One type of handle assembly, utilized with a ship, includes an interior handle located inside a structure of the ship and an exterior handle located outside the structure. Both the interior and exterior handles are typically shaped as elongated bars. One end of the exterior handle is pivotally attached within a recess of an exterior handle housing.

The exterior handle housing is mounted flush with the exterior surface of the structure and the exterior handle, in the closed position, is disposed flush within the exterior handle housing. The interior and exterior handles rotate in unison with one another between open and closed positions. As the exterior handle rotates to the open position, the exterior handle pivots out of the exterior handle housing and a free end of the exterior handle is positioned outside of the exterior handle housing. However, as a safety feature, rotation of the handles is restricted as long as the exterior handle is disposed within the exterior handle housing.

When the interior handle is rotated to the open position from inside the structure, the free end of the exterior handle is pivoted out of the exterior handle housing and the handles rotate in unison to the open position. A latch mechanism is thereby actuated to an unlocked position and the door can be opened. Alternatively, the door can also be opened from outside of the structure. The free end of exterior handle can be pivoted out the exterior handle housing and rotated causing both handles to rotate in unison to the open position. Similarly, the latch mechanism is thereby actuated to an unlocked position and the door can then be opened.

This type of handle assembly suffers from certain disadvantages. Unfortunately, when the ship is operating in cold environments the exterior handle can become "iced-over" such that the exterior handle cannot pivot out of the exterior handle housing and the handle assembly becomes non-functional. When this occurs, the door cannot be opened by the use of either the interior or the exterior handle, resulting in individuals being "locked-in" or "locked-out" from the ship, respectively.

In view of the above, it should be appreciated that there is a need for a handle assembly that allows the door to be opened when the exterior handle becomes iced-over.

SUMMARY OF THE INVENTION

The present invention resides in a translating handle assembly that provides advantages over known handle assemblies in that it allows a door to be opened even when the exterior handle becomes iced-over.

The translating handle assembly of the present invention actuates a latch mechanism to releasably secure a door to a structure. The handle assembly includes a housing, an interior handle, an exterior handle, an actuator, and a translating shaft. The housing mounts the handle assembly to the structure and defines an exterior handle housing having a recess. The interior handle is rotatable between closed and open positions and is located interiorly of the housing. The exterior handle is disposed within the recess of the exterior handle housing in the closed position and is axially displaced from the recess of the exterior handle housing in the open position. The exterior handle rotates in unison with the interior handle between closed and open positions only when it is axially displaced.

The actuator is slidably mounted to the housing for actuating a latch mechanism which secures and releases the door to the structure. The translating shaft is connected between the interior handle and the exterior handle and is rotatably coupled to the actuator.

When the interior handle is rotated between closed and open positions, the translating shaft moves axially between non-extended and extended positions and rotates with the interior handle. This axial and rotational motion of the translating shaft displaces and rotates the exterior handle such that the exterior handle moves axially out of the recess of the exterior handle housing and rotates in unison with the interior handle to the open position. Furthermore, the rotation of the translating shaft drives the actuator for actuating the latch mechanism to release the door from the structure.

A feature of the translating handle assembly is that, when necessary or desired, the interior handle can be pushed axially outwards to force the translating shaft to move from the non-extended position to the extended position thereby axially displacing the exterior handle from the recess of the exterior handle housing. After the exterior handle has been axially displaced from the exterior handle housing, the interior handle can be rotated to the open position causing the exterior handle and the translating shaft to rotate in unison with the interior handle actuating the latch mechanism and releasing the door from the structure. The door can then be opened. Thus, if the exterior handle has become iced-over and individuals are locked-in the structure of the ship, the door can be opened by simply pushing the interior handle which causes the exterior handle to eject out of the exterior handle housing, breaking the exterior handle out of the iced-over condition, so that the door can be opened.

In some embodiments, the exterior handle housing has a finger well to aid in grabbing and pivoting the free end of the exterior handle from the recess of the exterior handle housing. Thus, if the exterior handle becomes iced-over and individuals are locked-out of the structure of the ship, the exterior handle can still be pivoted out of the exterior handle housing by using the finger well so that the door can be opened from outside of the structure.

Other features and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENTS

Figure 1:
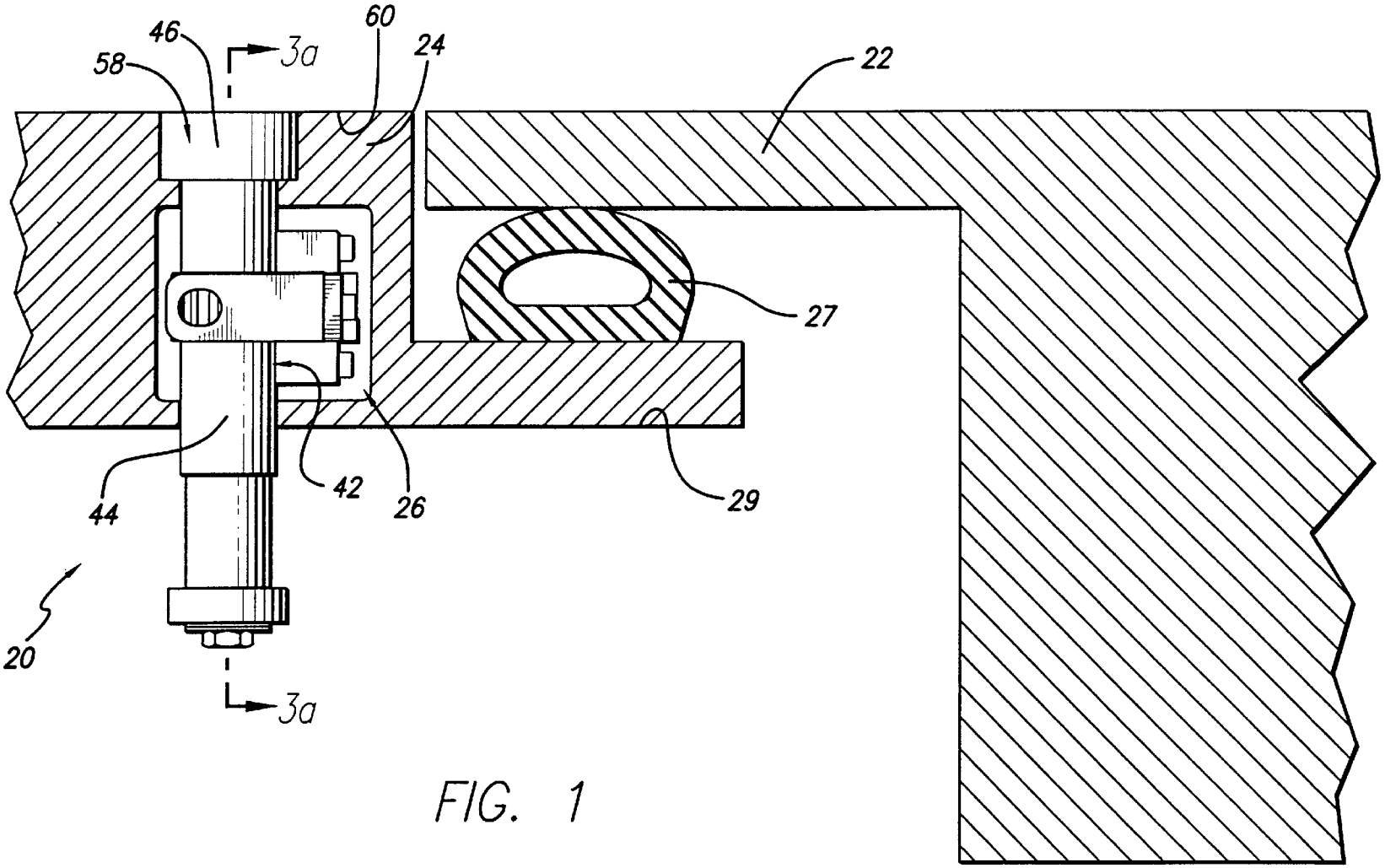
FIG. 1 is a side sectional view of a translating handle assembly according to the invention mounted within a structure and shows a door in a closed position compressing a seal between the door and the associated structure.

The translating handle assembly of the present invention actuates a latch mechanism to releasably secure a door to a structure. The translating handle assembly is used to open and close a door for allowing individuals to move in and out of the structure or for providing access to items stored within the structure. As shown in the exemplary drawings, and with particular reference to FIG. 1, the invention is embodied in a translating handle assembly 20 for controlling the opening and closing of a door 22 which is pivotally mounted to a structure 24. The handle assembly is mounted within an aperture 26, rectangular in cross-section, which extends through the structure. The structure has an exterior surface 60 and an interior surface 29. A seal 27 is mounted between the structure and the door for providing proper sealing when the door is closed.

Figure 2:
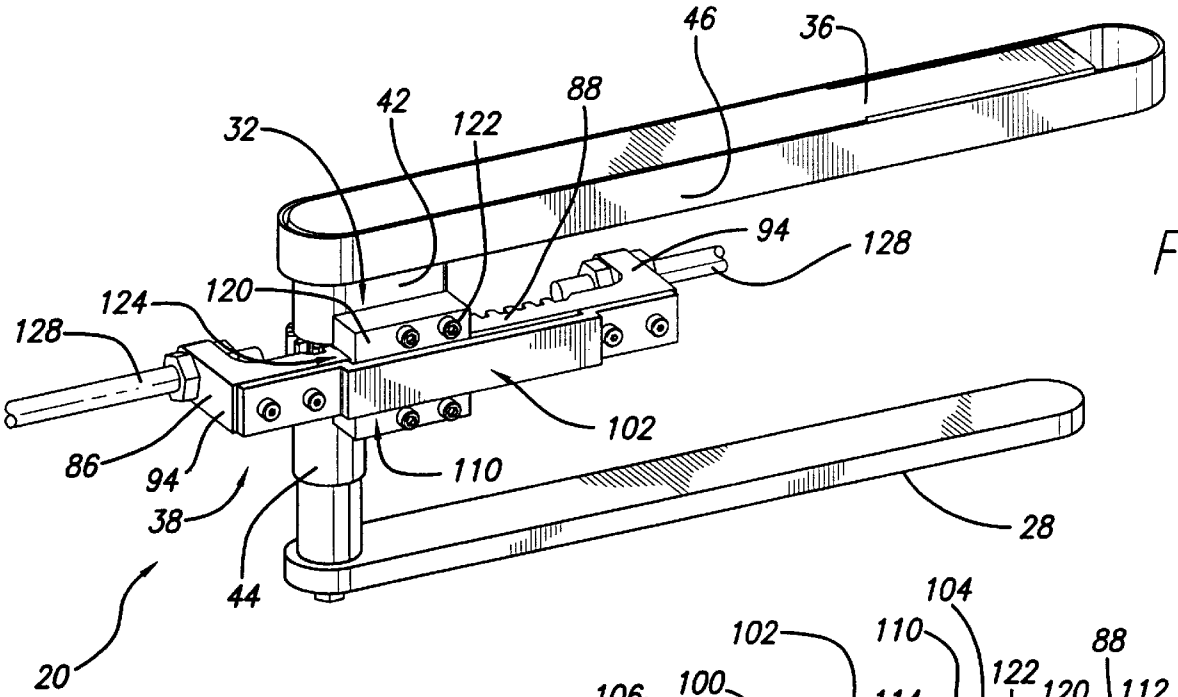
FIG. 2 is a perspective view of the translating handle assembly shown in FIG. 1.

With reference to FIG. 2, which is a perspective view of the handle assembly 20, it can be seen that the handle assembly includes a housing 32, an interior handle 28, an exterior handle 36, an actuator 38, and a translating shaft 40 (not shown). The components of the translating handle assembly are preferably made from stainless steel, or other non-corrosive materials, suitable for proper functioning in a salt water environment.

Figure 3A:
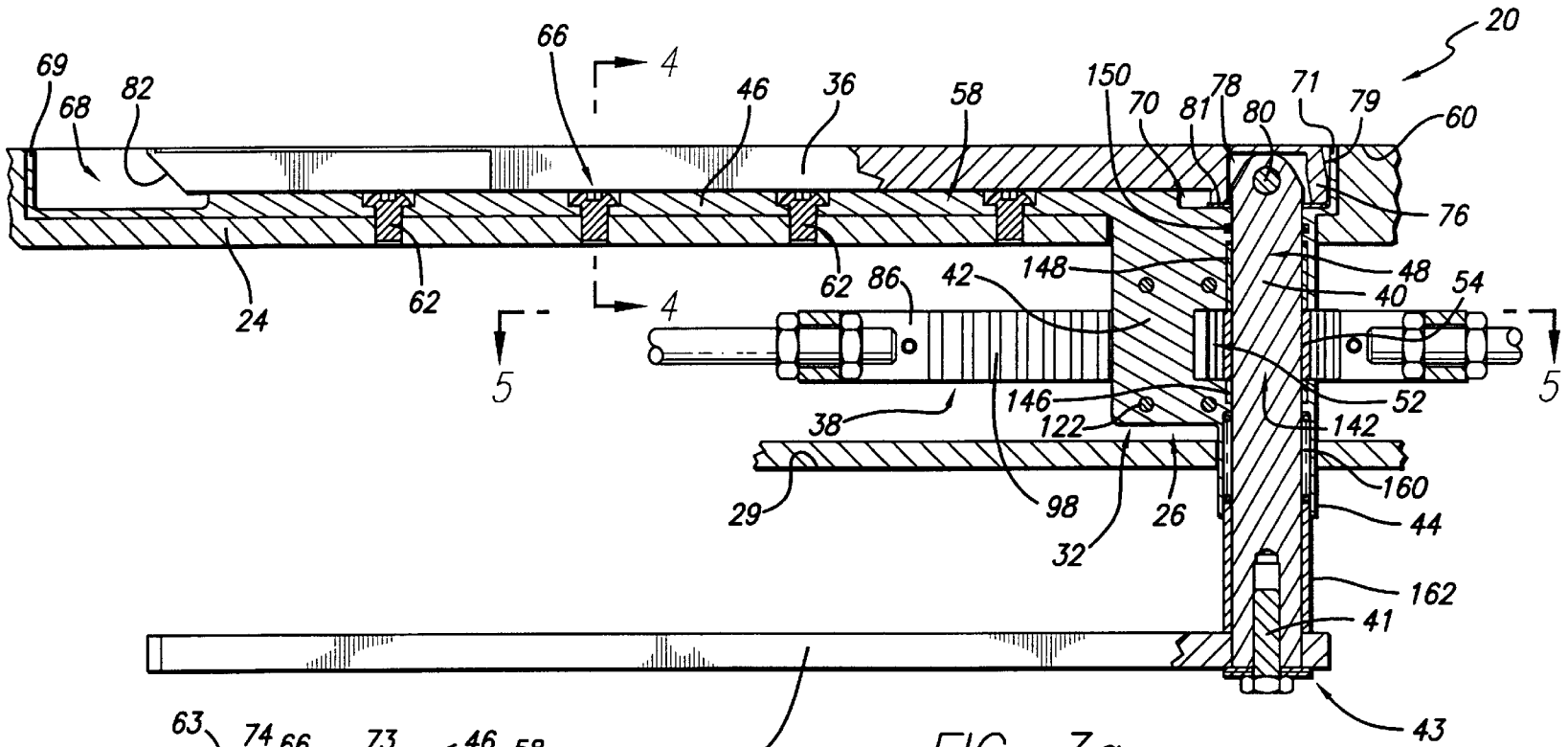
FIG. 3*a* is a sectional view of the translating handle assembly taken along line 3*a*—3*a* in FIG. 1 illustrating the exterior handle and the translating shaft in a non-extended position.

The housing 32 includes a central portion 42 with a rectangular cross section having a cylindrical portion 44 at one end and an exterior handle housing 46 at the other. As best seen in FIG. 1, the central portion fits within the aperture 26 of the structure 24 and the cylindrical portion extends through the interior surface 29 of the structure. The exterior handle housing fits within a recess 58 of the structure and is mounted flushly to the exterior surface 60 of the structure. As best seen in FIG. 3*a*, a cylindrical bore 48 extending axially through the housing accepts the translating shaft 40 and the central portion includes an opening 52 having a rectangular cross-section that extends transversely therethrough for accepting a pinion 54 mounted around the translating shaft.

Figure 4:
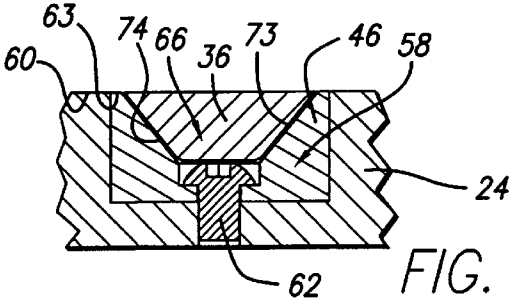
FIG. 4 is a sectional view of the translating handle assembly taken along line 4—4 in FIG. 3*a* illustrating the exterior handle disposed within the exterior handle housing in the closed and non-extended position.

Turning to FIG. 4, it can be seen that the exterior handle housing 46 is mounted within the recess 58 of the structure 24 by a plurality of socket headed buttons 62. The exterior handle housing is channel-shaped having angled sidewalls 74 and defines a recess 66 for stowing the exterior handle 36 flushly with both the exterior surface 63 of the exterior handle housing and the exterior surface 60 of the structure. Referring again to FIG. 3*a*, it can be seen that the exterior handle housing has a concave finger well 68 at its outer end 69 and a concave handle well 70 at its inner end 71.

The interior handle 28 rotates between closed and open positions and is shaped as an elongated bar. The interior handle is mounted within the interior of the structure 24 parallel to the interior surface 29 of the structure. A fastener 41, such as a hex bolt, fixedly mounts the interior handle to the translating shaft 40. Also, a pair of washers 43 are interposed between the fastener and the interior handle.

The exterior handle 36 rotates in unison with the interior handle 28 between closed and open positions when displaced outside of the exterior handle housing and is shaped as an elongated bar having an inner end 79 and outer end 82. As best seen in FIG. 4, the exterior handle has angled sidewalls 73 and, when in the closed position, fits within the recess 66 of the exterior handle housing 46 so that the angled sidewalls of the exterior handle mate with the angled sidewalls 74 of the exterior handle housing.

As shown in FIG. 3*a*, the inner end of the exterior handle includes a cylindrical head 76 with an opening 78 for receiving an end of the translating shaft 40. The cylindrical head is pivotally mounted to the translating base by a fastener 80, such as a rivet, which extends through the cylindrical head and the translating shaft. The outer end 82 can be pivoted out of the exterior handle housing about the fastener as the cylindrical head pivots within the concave handle well 70. A thrust washer 81 is mounted around the translating shaft, within the concave handle well, to reduce wear between the exterior handle and the exterior handle housing. The outer end of the exterior handle is angled to aid in gripping the exterior handle making it easier to pivot the exterior handle out of the exterior handle housing.

Figure 5:
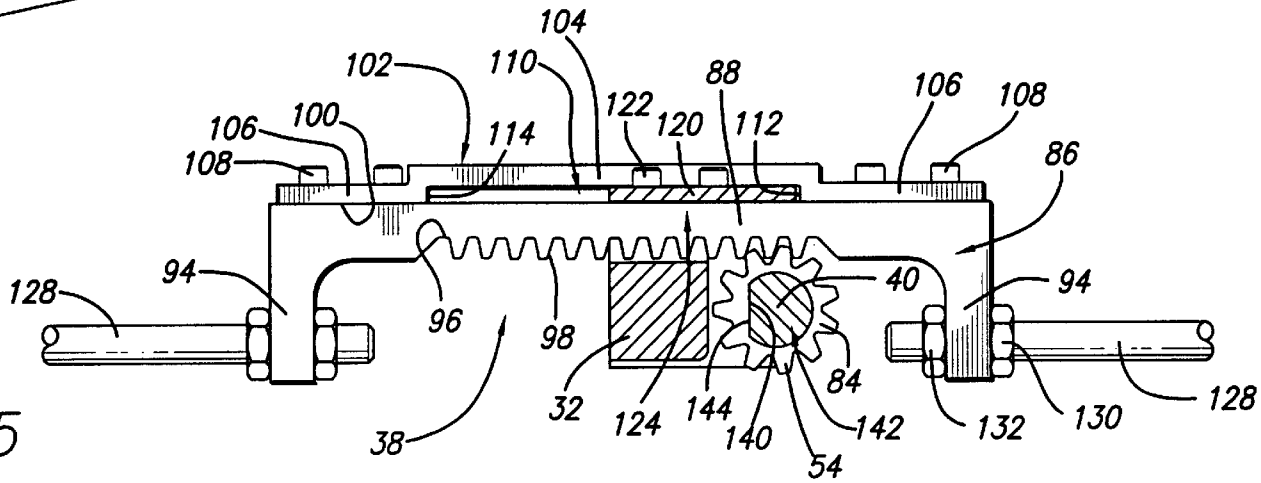
FIG. 5 is a side sectional view of an actuator and a translating shaft taken along line 5—5 in FIG. 3*a*.

As best seen in FIG. 5, which is a partially cut away side view of the actuator 38, the actuator is slidably mounted to the housing 32 for actuating the latch mechanism. The pinion 54 having a plurality gears 84 is mounted around the translating shaft 40 for rotatably engaging the actuator. The actuator includes a U-shaped rack 86 having a base 88, a pair of depending flanges 94, and a handle stop 102. The flanges of the rack are spaced apart by the base and are parallel to each other. The base has an interior surface 96 with a plurality of gears 98 that engage the gears of the pinion and an exterior surface 100 to which the handle stop is mounted. The handle stop has a U-shaped base portion 104 and a pair of mounting legs 106. Socket headed screws 108 extend through the mounting legs and mount the handle stop to the exterior surface of the rack. A slot 110 is defined between the base portion of the handle stop and the exterior surface of the rack. The slot of the handle stop has a locked end 112 and an unlocked end 114.

Returning to FIG. 2, a rack mounting block 120 is mounted to the housing 32 of the handle assembly 20 by a plurality of hex bolts 122 and slidably mounts the rack 86 to the housing. The rack mounting block is channel-shaped. As shown in FIG. 5, the rack mounting block defines an opening 124 through which the base 88 of the rack can slide. The slot 110 of the handle stop 102 accepts the rack mounting block between the locked end 112 and the unlocked end 114 of the slot. The rack slides within the opening of the mounting block, as the handles are rotated between closed and open positions, but the motion of the rack is limited to the slot of the handle stop which slidably engages the fixed mounting block. Thus, the handle stop limits the movement of the actuator 38 and thereby limits the amount of rotation of the handles.

A rod 128 is mounted through each flange 94 of the rack 86 by a pair of bolts 130 and 132. Each rod is respectively connected to a latch mechanism, or a series of latch mechanisms, such that the lateral movement of the rack moves the rods to actuate the latch mechanism(s) for securing and releasing the door to and from the structure. Conventional latch mechanisms for this purpose are well known in the art.

The translating shaft 40 is moveable between non-extended and extended positions. With reference again to FIG. 3*a*, the translating shaft is shown in the non-extended position. The translating shaft is connected between the interior handle 28 and the exterior handle 36, and extends through the cylindrical bore 48 of the housing 32. The translating shaft is also rotatably coupled to the actuator 38 by the pinion 54 which is mounted around the translating shaft and engages the gears 98 of the actuator.

As shown in FIG. 5, the translating shaft 40 is substantially cylindrically shaped with a flat portion 140. The pinion 54 has an opening 142 having a mating flat portion 144 which accepts the translating shaft. The mating flat portions of the translating shaft and the pinion allow the translating shaft to move axially through the opening in the pinion between non-extended and extended positions when an axial force is applied and allows the translating shaft move the pinion thereby driving the actuator 38 and actuating the latch mechanism when a rotational force is applied. The handles rotating towards the open or closed positions provides this rotational force. The translating shaft rotates with the handles thereby rotating the pinion such that the flat portion of the translating shaft engages the mating flat portion of the pinion. The mating flat portions allow the translating shaft to move axially through the opening in the pinion while simultaneously rotating the pinion to drive the actuator. The gears 84 of the pinion engage the gears 98 of the rack 86 such that the rotation of the pinion slides the rack of the actuator through the slot 124 of the rack mounting block 120.

Referring again to FIG. 3*a*, first and second oil bushings 146 and 148 are mounted around the translating shaft 40 within the central portion 42 of the housing 32 to reduce wear between the translating shaft and the housing. Also, a quad ring 150 is interposed between the translating shaft and the central portion of the housing to provide proper sealing between the shaft and the housing.

A spring 160 is mounted around the translating shaft 40 within the cylindrical portion 44 of the housing 32 for biasing the translating shaft to the non-extended position and the exterior handle 36 to the closed position. A bushing 162 is mounted around the translating shaft between the interior handle 28 and the spring. The spring is positioned between the housing and the bushing such that the action of the spring biases the bushing and the interior handle away from the interior surface 29 of the structure 24, in turn biasing the translating shaft towards the non-extended position and the exterior handle towards the closed position.

The method of use and operation of the translating handle assembly 20, constructed as described above, proceeds as follows.

Figure 6A:
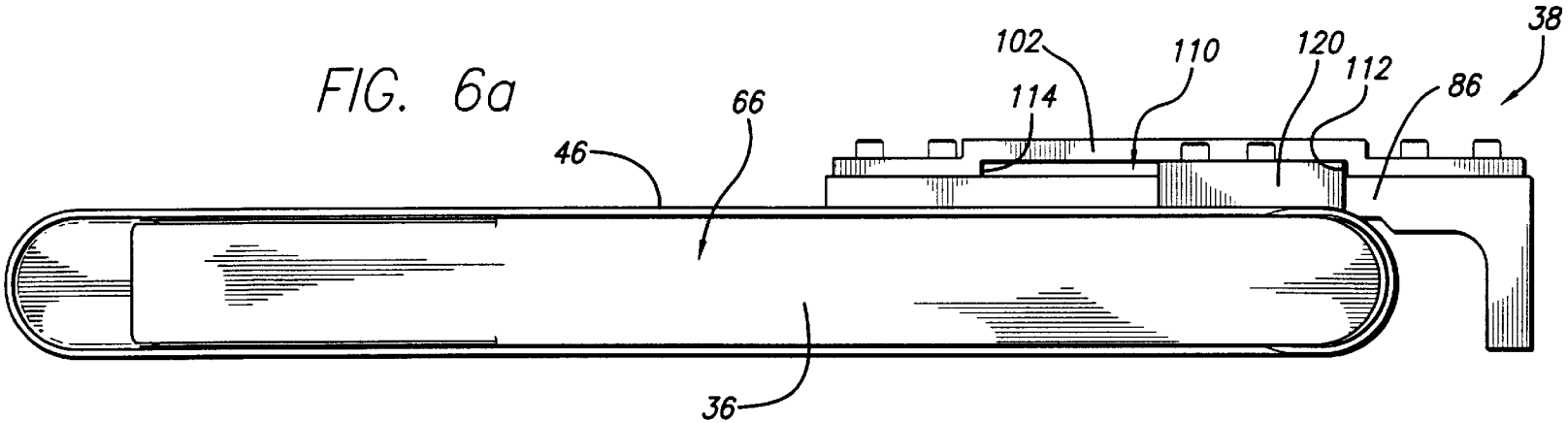
FIG. 6*a* is a plan view of the handle assembly shown in FIG. 1 illustrating the exterior handle in the closed position and the actuator in a locked position.
Figure 6B:
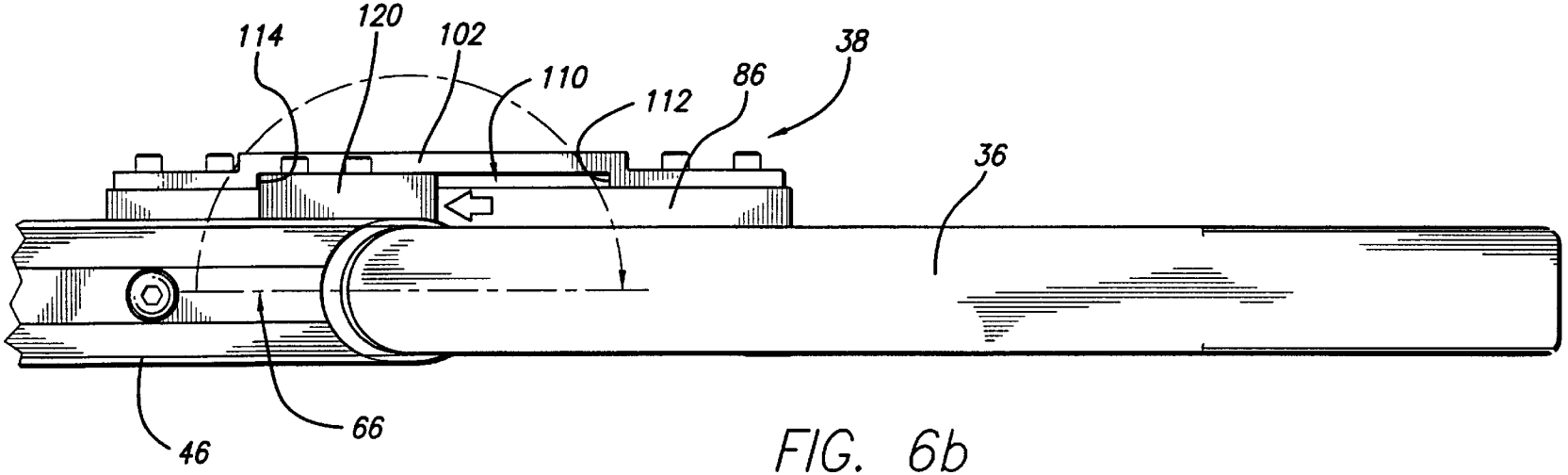
FIG. 6*b* is a plan view of the handle assembly illustrating the exterior handle moved from the closed position of FIG. 6*a* to an open position and the actuator moved from the locked position of FIG. 6*a* to an unlocked position.

As shown in FIG. 3*a*, when the translating handle assembly 20 is closed, the interior handle 28 is in the closed position, the translating shaft 40 is in the non-extended position, and the exterior handle 36 is in the closed position. In the closed position, the exterior handle is disposed flush within the recess 66 of the exterior handle housing 46. Also, as shown in FIG. 6*a*, when the interior and exterior handle are in the closed position, the actuator 38 is in a locked position such that the locked end 112 of the slot 110 of the handle stop 102 abuts the rack mounting block 120. In this position, the actuator drives the latch mechanism to the locked position such that the latch mechanism secures the door to the structure. FIG. 6*b* shows the exterior handle in the open position and the actuator in an unlocked position.

Figure 3B:
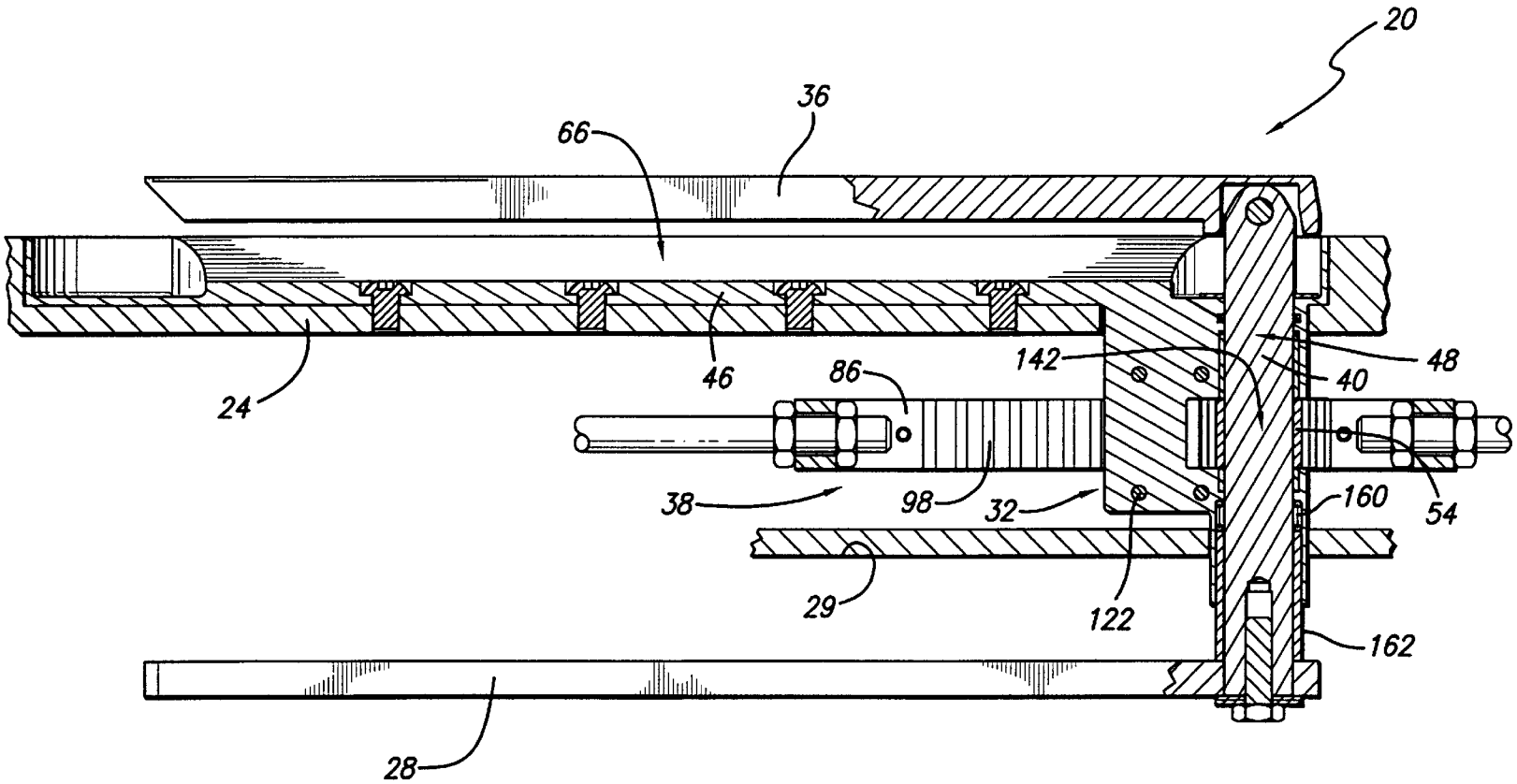
FIG. 3*b* is a sectional view of the translating handle assembly shown in FIG. 3*a* illustrating the exterior handle and the translating shaft in an extended position.

FIG. 3*b* illustrates the exterior handle 36 and the translating shaft 40 in an extended position. As the interior handle 28 is rotated towards the open position, the sidewalls 73 (FIG. 4) of the exterior handle ride along the sidewalls 74 (FIG. 4) of the exterior handle housing 46 causing the translating shaft to move axially through the bore 48 of the housing 32 and the opening 142 of the pinion 54, approximately 0.5 inches, from the non-extended position of FIG. 3*a*, to the extended position of FIG. 3*b*, such that the exterior handle moves axially out of the exterior handle housing, approximately 0.5 inches, from the closed position of FIG. 3*a* to the axially displaced position shown in FIG. 3*b*. This initial rotation causes the interior handle to move axially, towards the interior surface 29 of the structure 24, such that the bushing 162 compresses the spring 160.

To release the door from the structure 24, the interior handle 28 is rotated a full 180 degrees to the open position and the translating shaft 40, the pinion 54, and the exterior handle 36 rotate in unison with the interior handle. As the interior handle and exterior handle rotate in unison 180 degrees, from the closed position to the open position, the rack 86 moves from the position of FIG. 6*a*, where the actuator 38 is in the locked position with the locked end 112 of the slot 110 of the handle stop 102 abutting the rack mounting block 120, to the position of FIG. 6*b*, where the rack is moved to a position in which the unlocked end 114 of the slot of the handle stop abuts the mounting block moving the actuator to the unlocked position. In this position, the actuator drives the latch mechanism to the unlocked position such that the latch mechanism releases the door from the structure so that the door can be rotated open. FIG. 6*b* also shows the exterior handle moved out of the recess 66 of the exterior handle housing 46 and rotated in unison with the interior handle, 180 degrees, to the open position.

A feature of the translating handle assembly 20 is that, if necessary or desired, the interior handle 28 can also be pushed axially outwards causing the translating shaft 40 to move from the non-extended position, shown in FIG. 3*a*, to the extended position, shown in FIG. 3*b*, thereby axially displacing the exterior handle 36 from the recess 66 of the exterior handle housing 46. After the exterior handle has been axially displaced from the exterior handle housing, the interior handle can be rotated to the open position causing the exterior handle and the translating shaft to rotate in unison with the interior handle actuating the latch mechanism and releasing the door from the structure 24. The door can then be opened. Thus, if the exterior handle has become iced-over and individuals are locked-in the structure of the ship, the door can be opened by simply pushing the interior handle. This causes the exterior handle to eject out of the exterior handle housing, breaking the exterior handle out of the iced-over condition, such that the door can be opened.

Figure 3C:
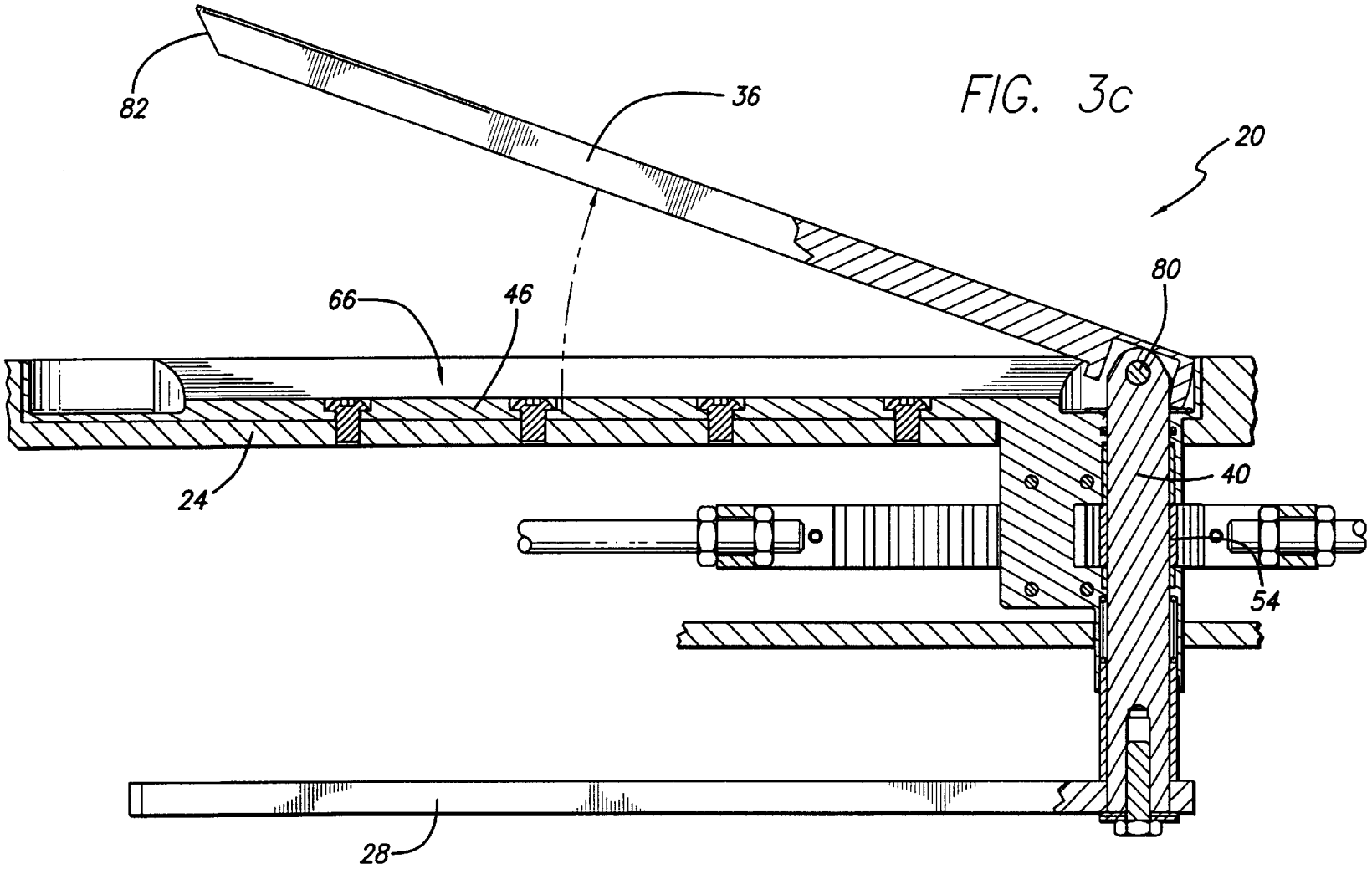
FIG. 3*c* is a sectional view of the translating handle assembly shown in FIG. 3*a* illustrating the exterior handle and the translating shaft in an extended position with the exterior handle pivoted outward.

As shown in FIG. 3*c*, the door can also be opened from outside of the structure 24 by the exterior handle 36. The exterior handle is grabbed at its angled outer end 82 and pivoted about the fastener 80 out of the recess 66 of the exterior handle housing 46. The exterior handle is then rotated 180 degrees towards the open position and the translating shaft 40, the pinion 54, and the interior handle 28 rotate in unison with the exterior handle. The exterior handle is fully rotated to the open position shown in FIG. 6*b* such that the latch mechanism releases the door from the structure and the door can then be rotated open.

The door can be closed from either inside or outside the structure 24 by the use of the interior handle 28 or the exterior handle 36, respectively. The process by which the handle assembly 20 closes is simply the reverse of the process by the which the handle assembly is opened. The interior or exterior handle is rotated 180 degrees back to its closed position and the translating shaft 40 rotates in unison with the handles thereby rotating the pinion 54. As shown in FIG. 5, the gears 84 of the pinion engage the gears 98 of rack 86 of the actuator 38 sliding the rack through the slot 124 of the rack mounting block 120.

With reference to FIGS. 6*a* and 6*b*, as the interior handle 28 and exterior handle 36 are rotated in unison 180 degrees, from the open position to the closed position, the rack 86 moves from the position of FIG. 6*b*, where the rack is positioned with the unlocked end 114 of the slot 110 of the handle stop 102 abutting the rack mounting block 120 and the actuator 38 is in the unlocked position, to the position of FIG. 6*a*, where the rack is moved such that the locked end 112 of the slot of the handle stop abuts the rack mounting block and the actuator is in the locked position. In the locked position, the actuator drives the latch mechanism to the locked position such that the latch mechanism secures the door to the structure. Further, as shown in FIG. 3*a*, the spring 160 biases the translating shaft 40 back to the non-extended position and the exterior handle back to the closed position such that the exterior handle is again disposed flush within the recess 66 of the exterior handle housing 46.

A further feature of the translating handle assembly 20, as shown in FIG. 3*a*, is that the exterior handle housing 46 has a finger well 68 to aid in grabbing and pivoting the angled outer end 82 of the exterior handle 36 from the recess 66 of the exterior handle housing. Thus, if the exterior handle becomes iced-over and individuals are locked-out of the structure 24 of the ship, the exterior handle can still be pivoted out of the exterior handle housing by using the finger well so that the door can be opened.

Those skilled in the art will recognize that other modifications and variations can be made in the translating handle assembly of the invention and in the construction and operation of the handle assembly without departing from the scope or spirit of this invention. For example, it should be understood that this device could also be used to operate a variety of different door latch mechanisms on a variety of different vehicle structures, as well as, stationary structures. With such possibilities in mind, the invention is defined with reference to the following claims.

I claim:

1. A translating handle assembly for actuating a latch mechanism to releasably secure a door to a structure, the handle assembly comprising:

a housing for mounting the handle assembly to the structure, the housing including an exterior handle housing having a recess;

an interior handle rotatable between closed and open positions located interiorly of the housing;

an exterior handle rotatable with the interior handle between closed and open positions, the exterior handle disposed within the recess of the exterior handle housing in the closed position and axially displaced from the recess of the exterior handle housing in the open position;

an actuator slidably mounted to the housing for actuating the latch mechanism; and a translating shaft, extending through the housing, connected to the interior handle and the exterior handle rotatably coupled to the actuator, so that the translating shaft is caused to move axially between non-extended and extended positions and rotates thereby axially displacing and rotating the exterior handle between closed and open positions and driving the actuator for actuating the latch mechanism.

2. The handle assembly of claim 1, wherein the translating shaft is cylindrical and extends through the housing.

3. The handle assembly of claim 2, further comprising a first fastener pivotally mounting the exterior handle to the translating shaft and a second fastener fixedly mounting the interior handle to the translating shaft.

4. The handle assembly of claim 1, wherein the exterior handle housing has a finger well.

5. The handle assembly of claim 1, further comprising a spring mounted around the translating shaft within the housing biasing the exterior handle to the closed position.

6. The handle assembly of claim 5, further comprising a bushing mounted around the translating shaft between the interior handle and the spring for compressing the spring against the housing when the shaft is in the extended position.

7. The handle assembly of claim 1, further comprising the exterior handle and the exterior handle housing have mating angled sidewalls such that as the interior handle is rotated between the closed and open position the sidewalls of the exterior handle ride along the sidewalls of the exterior handle housing causing the exterior handle to move axially out of the exterior handle housing and the translating shaft to move from the non-extended to the extended position.

8. The handle assembly of claim 1, further comprising a pinion having a plurality gears mounted around the translating shaft for rotatably engaging the actuator.

9. The handle assembly of claim 8, wherein the actuator includes a rack having a plurality of gears which intermesh with the gears of the pinion such that rotation of the pinion causes the rack to move relative to housing for actuating the latch mechanism.

10. The handle assembly of claim 9, wherein the translating shaft is cylindrical and has a flat portion, the translating shaft accepted by an opening in the pinion having a mating flat portion, the opening permitting the translating shaft to move axially through the opening in the pinion between non-extended and extended positions while simultaneously rotating the pinion.

11. A translating handle assembly for actuating a latch mechanism to releasably secure a door to a structure, the handle assembly comprising:

a housing for mounting the handle assembly to the structure, the housing including an exterior handle housing having angled sidewalls and a recess;

an interior handle rotatable between closed and open positions located interiorly of the housing;

an exterior handle rotatable with the interior handle between closed and open positions, the exterior handle having angled sidewalls which mate with the angled sidewalls of the exterior handle housing, the exterior handle disposed within the recess of the exterior handle housing in the closed position and axially displaced from the recess of the exterior handle housing in the open position;

an actuator slidably mounted to the housing for actuating the latch mechanism;

a cylindrical translating shaft connected to the interior handle and the exterior handle and extending through the housing;

a spring mounted around the translating shaft within the housing biasing the exterior handle to the closed position; and a pinion having a plurality of gears mounted around the translating shaft rotatably engaging the actuator, so that the translating shaft is caused to move axially between non-extended and extended positions and rotates thereby rotating the exterior handle between closed and open positions and rotating the pinion which drives the actuator for actuating the latch mechanism.

12. The handle assembly of claim 11, wherein the exterior handle housing has a finger well.

13. The handle assembly of claim 11, further comprising a bushing mounted around the translating shaft between the interior handle and the spring for compressing the spring against the housing when the shaft is in the extended position.

14. The handle assembly of claim 13, further comprising a first fastener pivotally mounting the exterior handle to the translating shaft and a second fastener fixedly mounting the interior handle to the translating shaft.

15. The handle assembly of claim 14, wherein the translating shaft has a flat portion, the translating shaft accepted by an opening in the pinion having a mating flat portion, the opening permitting the translating shaft to move axially through the opening in the pinion between the non-extended and extended positions while simultaneously rotating the pinion.

16. The handle assembly of claim 15, wherein the actuator comprises a rack having a plurality of gears which intermesh with the gears of the pinion such that the rotation of the pinion causes the rack to move relative to housing for actuating the latch mechanism.

* * * * *